United States Patent [19]

Will

[11] Patent Number: 4,705,430

[45] Date of Patent: Nov. 10, 1987

[54] COMPOSITE LEG PLATFORM

[75] Inventor: Stephen A. Will, Spring, Tex.

[73] Assignee: McDermott Incorporated, New Orleans, La.

[21] Appl. No.: 823,556

[22] Filed: Jan. 29, 1986

[51] Int. Cl.[4] ..... E02B 17/02

[52] U.S. Cl. ..... 405/227; 405/195; 405/204; 405/224

[58] Field of Search ..... 405/224, 227, 203, 204, 405/225, 226, 195

[56] References Cited

U.S. PATENT DOCUMENTS

| | | | |
|---|---|---|---|
| 3,528,254 | 9/1970 | Graham | 405/204 |
| 3,729,940 | 5/1973 | Koehler | 405/227 |
| 3,987,636 | 10/1976 | Hruska et al. | 405/227 X |
| 4,026,227 | 5/1977 | Cohn et al. | 405/227 X |
| 4,080,795 | 3/1978 | Weidler, Jr. | 405/227 |
| 4,126,008 | 11/1978 | Dixon | 405/227 |
| 4,184,790 | 1/1980 | Bassett | 405/227 X |
| 4,214,843 | 7/1980 | Rohde | 405/203 |
| 4,275,974 | 6/1981 | Knox | 405/227 |
| 4,556,342 | 12/1985 | Tannahill | 405/204 |
| 4,576,523 | 3/1986 | Smetak | 405/195 X |

*Primary Examiner*—Dennis L. Taylor

*Attorney, Agent, or Firm*—Robert J. Edwards; Michael L. Hoelter

[57] ABSTRACT

A deep water offshore drilling platform having a jacket secured to driven skirt piles at an elevation above the sea floor of at least 100 feet and upwards of 300 feet. A series of connecting plates transfer the structural forces of the platform from the jacket to the skirt piles at these elevated connections. Due to the transfer of these forces, the size and weight of the jacket below this elevation may be significantly reduced to lower the cost of the platform. Additionally, the well casing is an integral component of the supporting members of the platform and the upper region of this well casing is expanded and oriented vertically to provide spacing for the well head and to eliminate the need for more costly slant-well drilling.

5 Claims, 17 Drawing Figures

COMPOSITE LEG PLATFORM

FIELD OF THE INVENTION

The present invention relates generally to fixed offshore drilling platforms and more specifically to pile-secured deep water platforms.

BACKGROUND OF THE INVENTION

As the production of oil and gas resources has moved into deeper and deeper waters, platform structures have correspondingly become much heavier and more expensive. Deep water structures, which typically refers to structures designed for water over 1000′ deep, typically weight, for example, in the tens of thousands of tons. The tremendous weight and size of these structures along with the loading condition they are to withstand makes them quite costly to build with this cost generally measured in the thousands of dollars per ton. Weight is also a major factor in the handling and installatione xpense, thus a general rule of thumb is the less a deep water structure weights, the less costly it is to construct and install.

A good overview of the development of off-shore platforms with special emphasis on deep water structures is found in the article entitled "Design and Construction of Deep Water Jacket Platforms" by Griff C. Lee, *Mechanical Engineering* April, 1983, pages 26-36. This article discusses the various types of deep water structures along with their construction and utilization. In summary it indicates that fixed platforms have been proven to be the most dependable, cost effective and efficient support system available for offshore drilling and production operations. These platforms are, however, out of necessity, all tremendously heavy and costly to fabricate. Generally, two thirds of the weight of a structure is in its lower one-third, thus improvements in anchoring the structure to the sea bed which reduces the weight of the structure is eagerly desired. Additionally, improvements which reduce the platform load and which eliminate or reduce the amount of surface area exposed to wave action is also highly desired.

It is thus an object of this invention to construct a deep water platform with significantly reduced jacket structure requirements. Anothe robject of this invention is to more efficiently utilize the structural supports of the jacket thereby exposing less surface area to wave action resulting in reduced design wave forces. This reduction in design force will consequently reduce the structural requirements and the weight of the platform. A further object of the invention is to anchor the platform by pilings to the sea floor such that the expensive lower jacket tubing can be designed to support significantly reduced static and dynamic forces, these forces being transfered to the less costly pike steel instead.

SUMMARY OF THE INVENTION

A deep water offshore platform having a support jacket that is secured to the sea floor by a multitude of piles. Skirt pile sleeves are rigidly connected to the main support legs of the jacket at an elevation above the sea floor a distance of at least 100 feet and upwards to 300 feet or so. Each elevated connection to the support leg includes at least one plate sized to transfer the structural loading from the jacket to the skirt piles which are driven into the sea bed closely adjacent each support leg. The support legs of this platform can be reduced in size below this connection because the structural forces are now carried by the skirt piles.

The well casing of the platform is incorporated into the structural configuration of the jacket and the upper region of this casing is expanded and extends vertically until connecting with the drilling rig. The remaining portion of the casing generally extends at an angle to vertical or has a batter while running roughly parallel to the main support legs of the jacket.

DETAILED DESCRIPTION OF THE INVENTION

Figures 1A, 1B:
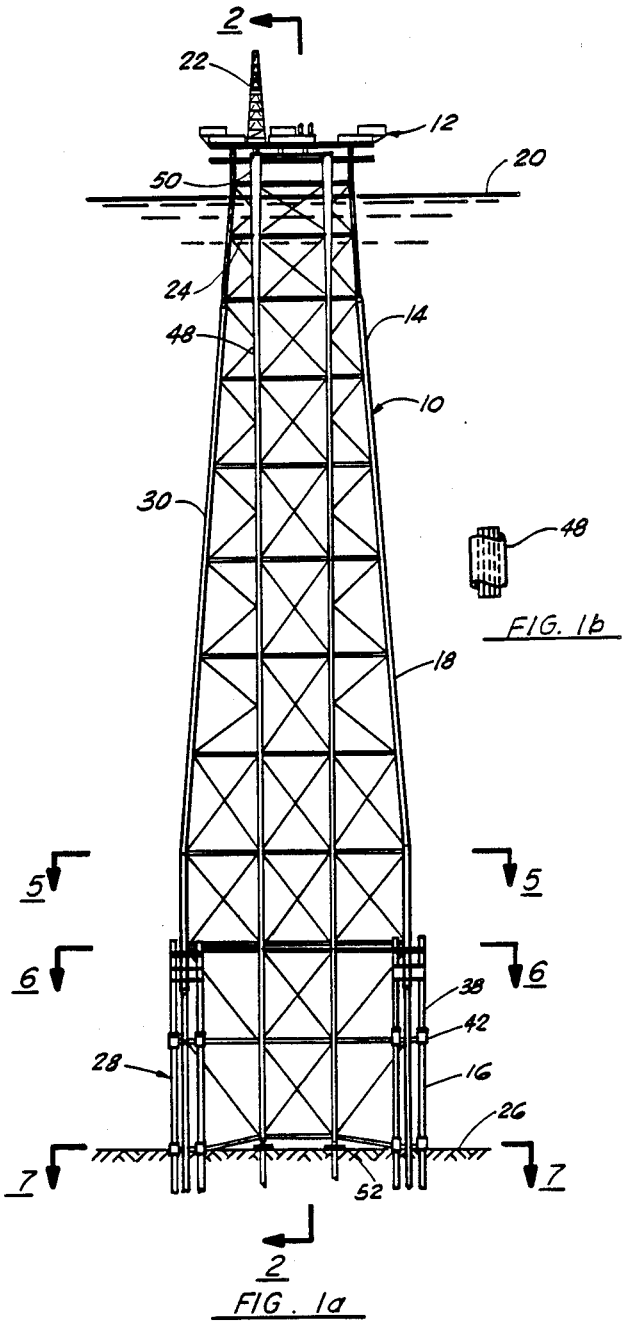
FIG. 1*a* is an elevation view, partially broken away and with the bracing removed for clarity, of the deep water platform illustrating the jacket and skirt pile assembly.
FIG. 1*b* is an enlarged view of a portion of the well casing as shown in FIG. 1*a*.
Figure 2:
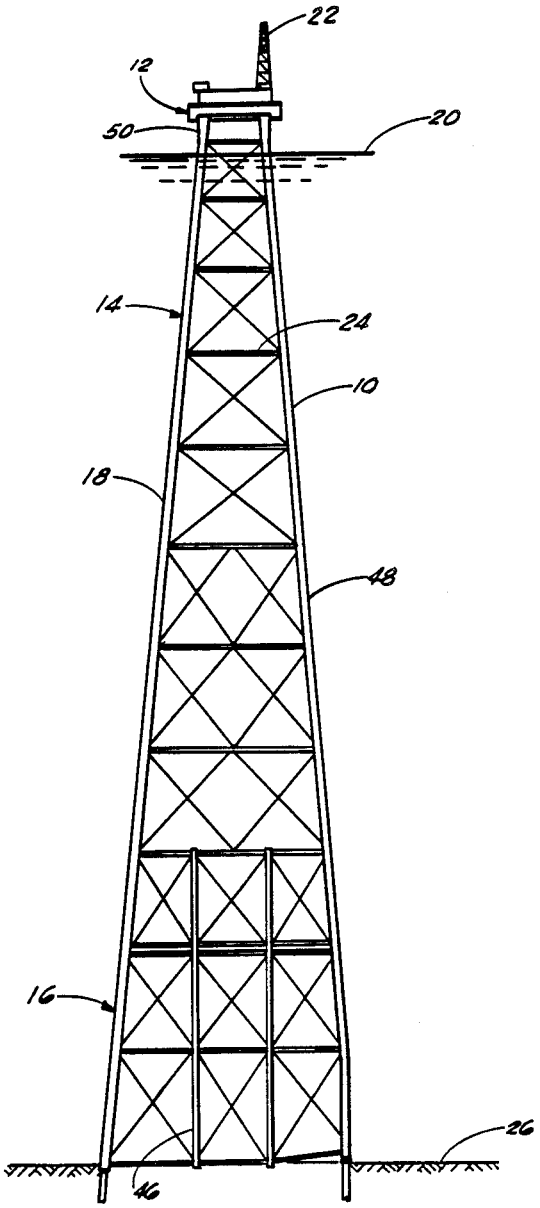
FIG. 2 is a sectional view, partially broken away and with the bracing removed for clarity, taken along lines 2—2 of FIG. 1, illustrating the well casing.

Referring initially to FIGS. 1 and 2, offshore drilling platform 10 can be divided into three general sections, deck section 12, jacket top section 14, and jacket base section 16. The latter two sections, 14 and 16, together forming jacket 18. However, it should be noted that jacket 18 can also be a one-piece jacket. Deck section 12 is that portion of platform 10 which extends above waterline 20 and this section supports drilling rig 22. Jacket top section 14 is composed mostly of elongated tubular steel members 24 and extends roughly from sea floor 26 to deck section 12. Jacket base section 16 is integrally secured to jacket top section 14, and base section 16 incorporates skirt p ile assembly 28 which rigidly supports platform 10 and anchors it to sea floor 26.

Figure 3:
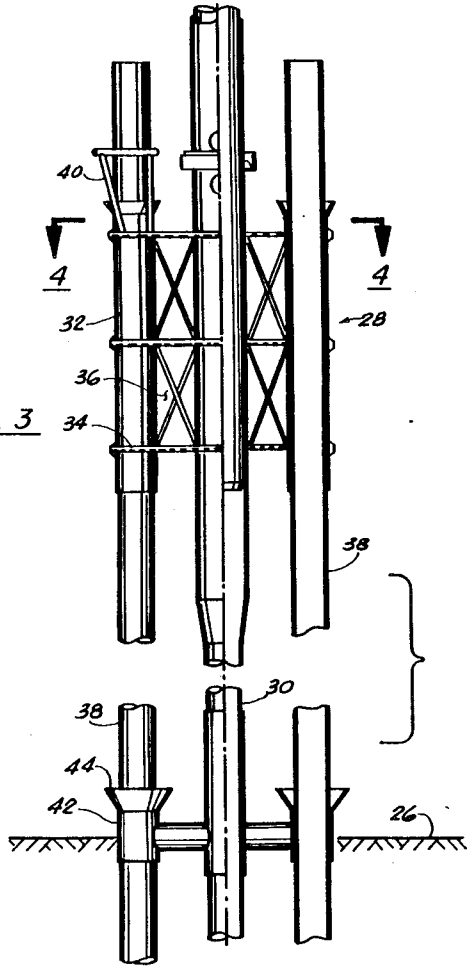
FIG. 3 is an enlarged view, partially broken away, of the elevated skirt pile to supporting connection.
Figure 4:
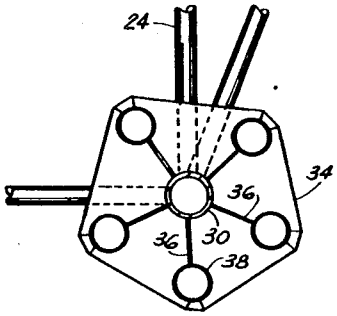
FIG. 4 is a sectional view, partially broken away, taken along lines 4—4 of FIG. 3.

Referring now also to FIGS. 3 and 4, skirt pile assembly 28 is secured to main support legs 30 of jacket 18. As illustrated, a series of five skirt pile sleeves 32 are rigidly connected to each support leg 30 through horizontal and vertical plates 34 and 36. In some cases, however, a greater or lesser number of such sleeves 32 may actually be so connected depending on the site characteristics, loading, and/or other factors. The elevation of these sleeve connections above sea floor 26 is generally at least 100 feet and conceivably upwards of approximately 300′ or more. Below this elevation, legs 30 which normally would be 15-20′ in diameter may be reduced in size as shown to save weight and reduce costs. This is because the forces of platform 10 are now transmitted through driven skirt pile 38 to sea floor 26 which is considerably less expensive material than the large diameter structural tubing.

Horizontal and vertical plates 34 and 36 directly connect skirt pile sleeves 32 to support legs 30 and these plates transfer the axial, shear, and bending movement forces from legs 30 to driven skirt piles 38 extending through sleeves 32. Pile sleeves 32 are closely clustered about each support leg 30 with the distance from the leg to each pile being approximatley 6 feet and with the spacing between piles being approximatley 15'. This is considerably less than the more conventional leg to pile distance of 100' and between pile spacing of 25–30 feet. Each sleeve 32 incorporates conical pile guide 40 connected to its upper end to aid in inserting skirt piles 38 through sleeves 32.

Skirt piles assembly 28, being rigidly connected to the elevated mid region of support legs 30, eliminates the need for costly and heavy bracing normally required for such a platform. This weight savings can be on the order of 10,000 tons which will tremendously reduce the cost of the platform. The horizontal and vertical plates 34 and 36 that transfer the structural forces of platform 10 from support leg 30 to the upper region of skirt piles 38 require no bracing because of the close proximity of the skirt piles to the support leg and the structural characteristic of plates. Consequently, the upper region of platform 10 is supported by support legs 30 while the lower region of platform 10 is supported by skirt piles 32. Thus platform 10 is a composite leg platform.

A series of lateral pile connections 42, which are illustrated as being secured to the reduced region of legs 30, maintain the alignment of skirt piles 38 as they extend parallel to legs 30 into sea floor 26. Lateral pike connections 42 provide lateral support for skirt piles 38 and connections 42 are generally not sized to transfer axial or bending moment forces to jacket 18. The sleeves 32 of these lateral pile connections 42, as illustrated, are sized slightly larger than skirt piles 38 and each sleeve 32 also includes a conical guide 44 to aid in inserting these piles therethrough.

Figure 5:
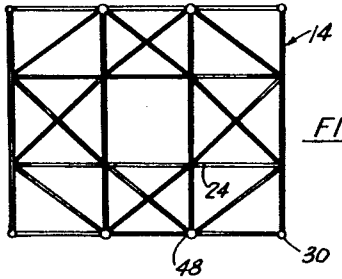
FIG. 5 is a sectional planer view, partially broken away, taken along lines 5—5 of FIG. 1.
Figure 6:
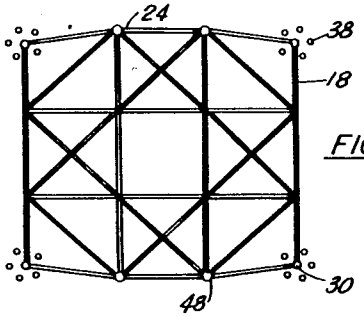
FIG. 6 is a sectional planer view, partially broken away, taken along line 6—6 of FIG. 1.
Figure 7:
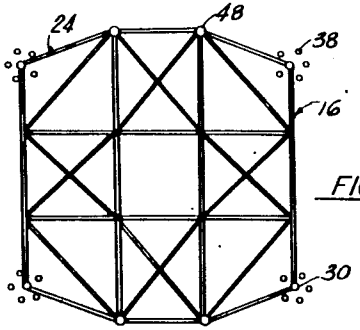
FIG. 7 is a sectional planer view, partially borken away, taken along lines 7—7 of FIG. 1.
Figures 8A, 8B, 8C, 8D, 8E, 8F:
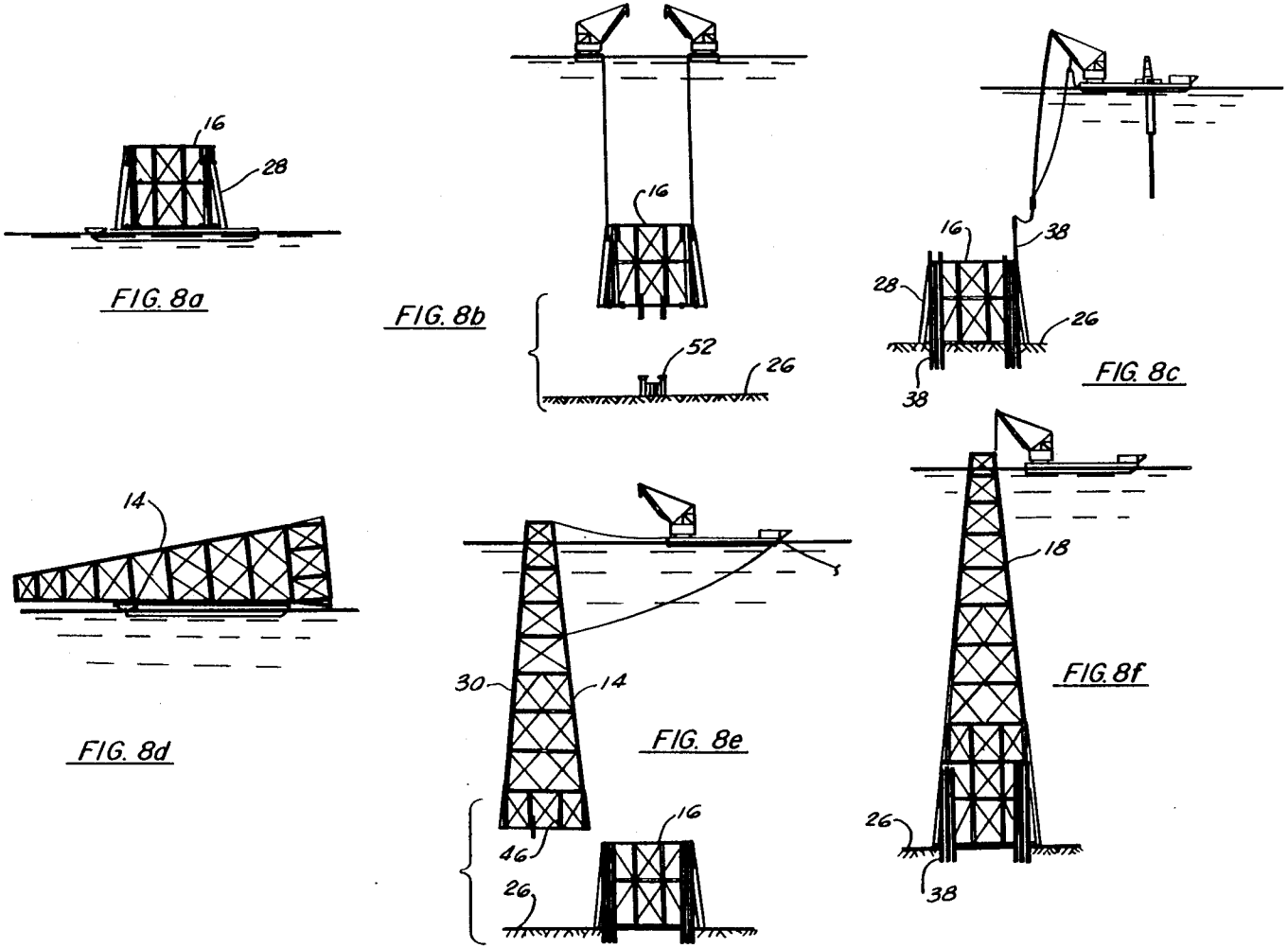
FIGS. 8*a–f* are schematic views illustrating the installation of a two piece jacket.

Referring now to FIGS. 5, 6 and 7, there is shown plan views of jacket 18 taken at different elevations below waterline 20. FIG. 5 is taken at the elevation where the main support legs 30 of jacket 18 change from an angled orientation or batter to a nearly vertical orientation. FIGS. 6 and 7 better illustrate the close proximity of skirt piles 38 to their respective support leg 30. Note also the decrease in diamter of legs 30 between FIG. 6 and FIG. 7. False support legs 46 interior of jacket 18 provide additional support to platform 10.

Referring now back to FIGS. 1 and 2, well casing 48, as shown, is a component of the jacket support structure. The upper region 50 of casing 48 is expanded such that there is sufficient spacing for the well head. Before reaching waterline 20, however, well casing 48 is reduced in size to reduce the wave design forces that platform 10 is subjected to. This upper region 50 is also oriented vertically as contrasted with the batter or angled orientation of the remainder of casing 48. This upper expanded and vertical region enables regular vertical drilling to occur thereby eliminating the need for slant drilling rigs and its associated higher cost. Often such slant drilling rigs were required in the past whenever it was desired to utilize the well casing as an integral component of the jacket structure because of the angle or batter of the well casing/structural component.

FIGS. 8*a–f* illustrate the various stages of installing a multiple piece platform. Initially jacket base section 16 is towed to the site and aligned with subsea template 52 before skirt piles 38, driven into the sea floor, anchor base section 16 in place. Afterward jacket top section 14 is similarly towed to the site and launched from the barge where selective tubes of the structure are flooded so as to control the bouyancy of this section. Jacket top section 14 is then positioned over base section 16 and secured to this section by leg pins (not shown). Deck section 12 follows shortly thereafter, which is lifted in place on top of jacket top section 14.

Figure 9A:
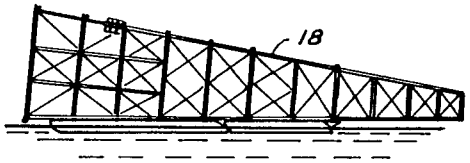
FIGS. 9*a–c* are schematic views illustrating the installation of a one piece jacket.
Figure 9B:
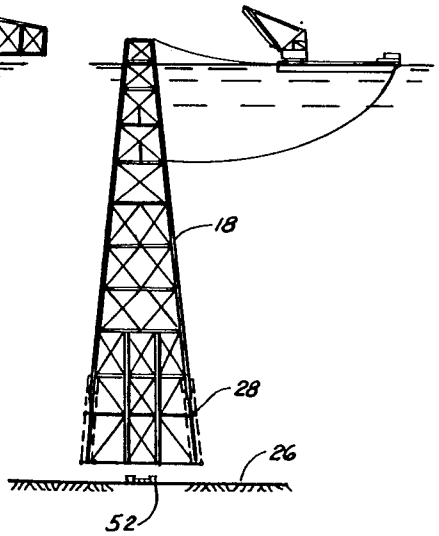
Figure 9C:
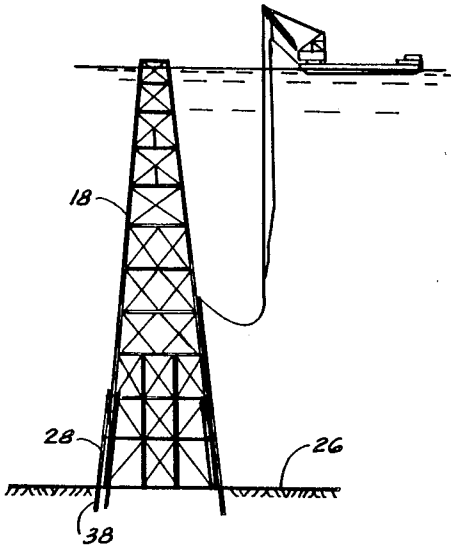

FIGS. 9*a–c* illustrate the installation of a one piece jacket 18. After jacket 18 is towed and launched, it is aligned over subsea template 52 before skirt piles 38 are driven to anchor jacket 18 to sea floor 26.

What is claimed is:

1. A composite leg platform comprising:

a. an elongated jacket with support legs, said legs having a reduced lower region;

b. A plurality of skirt piles embeded in the sea floor and connected to each said support leg;

c. a rigid connection between a said support leg and its respected plurality of skirt piles, said rigid connection being at an elevation above said reduced lower region of said support leg; and, d. at least one slip connection coupling the same said support leg and said plurality of skirt piles, said slip connection configured to provide lateral support to said support leg while enabling said support leg to move axially with respect to said skirt piles, said slip connection coupling to said reduced lower region of said support leg and wherein axial, shear, torque, and bending moment forces are transferred from said support legs through said slip and rigid connections to said skirt piles.

2. A composite leg platform as set forth in claim 1 wherein said jacket comprises a plurality of bays and said rigid connection is positioned intermediate the outermost bays.

3. A cmposite leg platform as set forth in claim 2 wherein said rigid connection is elevated above the sea floor by at least 100 feet.

4. A composite leg platform as set forth in claim 2 wherein said rigid connection is positioned in a midregion of said support leg.

5. A composite leg platform as set forth in claim 4 wherein said reduced leg region extends for a distance of approximately one-half of the height of said support leg.

* * * * *